US007093664B2

(12) United States Patent
Todd et al.

(10) Patent No.: US 7,093,664 B2
(45) Date of Patent: Aug. 22, 2006

(54) ONE-TIME USE COMPOSITE TOOL FORMED OF FIBERS AND A BIODEGRADABLE RESIN

(75) Inventors: Bradley L. Todd, Duncan, OK (US); Rajesh K. Saini, Duncan, OK (US); Loren C. Swor, Duncan, OK (US); Phillip M. Starr, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 301 days.

(21) Appl. No.: 10/803,668

(22) Filed: Mar. 18, 2004

(65) Prior Publication Data

US 2005/0205265 A1 Sep. 22, 2005

(51) Int. Cl.
*E21B 29/00* (2006.01)

(52) U.S. Cl. ..... 166/376; 166/317

(58) Field of Classification Search ..... None
See application file for complete search history.

(56) References Cited

U.S. PATENT DOCUMENTS

| | | | | |
|---|---|---|---|---|
| 2,238,671 | A | 4/1941 | Woodhouse | 166/21 |
| 2,703,316 | A | 3/1955 | Schneider | |
| 3,173,484 | A | 3/1965 | Huitt, et al. | 166/280.1 |
| 3,195,635 | A | 7/1965 | Fast | 166/280.1 |
| 3,302,719 | A | 2/1967 | Fischer | 166/280.2 |
| 3,364,995 | A | 1/1968 | Atkins, et al. | 166/280.1 |
| 3,366,178 | A | 1/1968 | Malone, et al. | 166/280.1 |
| 3,455,390 | A | 7/1969 | Gallus | 166/295 |
| 3,784,585 | A | 1/1974 | Schmitt et al. | 260/861 |
| 3,828,854 | A | 8/1974 | Templeton et al. | 166/307 |
| 3,868,998 | A | 3/1975 | Lybarger et al. | 166/278 |
| 3,912,692 | A | 10/1975 | Casey et al. | |
| 3,960,736 | A | 6/1976 | Free et al. | 252/8.55 R |
| 3,968,840 | A | 7/1976 | Tate | 166/280.1 |
| 3,998,744 | A | 12/1976 | Arnold et al. | 507/269 |
| 4,068,718 | A | 1/1978 | Cooke, Jr. et al. | 166/280.2 |
| 4,169,798 | A | 10/1979 | DeMartino | 252/8.55 R |
| 4,187,909 | A | 2/1980 | Erbstoesser | |
| 4,334,579 | A * | 6/1982 | Gregg | 166/256 |
| 4,387,769 | A | 6/1983 | Erbstoesser et al. | |
| 4,417,989 | A | 11/1983 | Hunter | |
| 4,470,915 | A | 9/1984 | Conway | 252/8.55 R |
| 4,526,695 | A | 7/1985 | Erbstoesser et al. | 252/8.55 R |
| 4,715,967 | A | 12/1987 | Bellis et al. | |

(Continued)

FOREIGN PATENT DOCUMENTS

WO WO 2000/57022 9/2000

(Continued)

OTHER PUBLICATIONS

Skrabal et al., *The Hydrolysis Rate of Orthoformic Acid Ethyl Ether*, Chemical Institute of the University of Graz, pp. 1-38.

(Continued)

*Primary Examiner*—Frank Tsay
(74) *Attorney, Agent, or Firm*—John W. Wustenberg; Baker Botts, L.L.P.

(57) ABSTRACT

The present invention is directed to disposable composite downhole tool formed of a resin-coated fiber. The fiber is formed of a degradable polymer, such as a poly(lactide) or polyanhydride. The resin is formed of the same degradable polymer as the fiber. It chemically bonds to the fiber, thereby making a strong rigid structure once cured. The fiber may be formed into a fabric before being coated with the resin. Alternatively, the fiber is formed of a non-biodegradable material.

65 Claims, 6 Drawing Sheets

U.S. PATENT DOCUMENTS

| | | | | |
|---|---|---|---|---|
| 4,716,964 | A | 1/1988 | Erbstoesser et al. | 166/284 |
| 4,743,257 | A | 5/1988 | Tormala et al. | |
| 4,809,783 | A | 3/1989 | Hollenbeck et al. | 166/307 |
| 4,843,118 | A | 6/1989 | Lai et al. | 524/555 |
| 4,848,467 | A | 7/1989 | Cantu et al. | 166/281 |
| 4,957,165 | A | 9/1990 | Cantu et al. | |
| 4,961,466 | A | 10/1990 | Himes et al. | 166/250 |
| 4,986,353 | A | 1/1991 | Clark et al. | 166/279 |
| 4,986,354 | A | 1/1991 | Cantu et al. | 166/279 |
| 4,986,355 | A | 1/1991 | Casad et al. | |
| 5,082,056 | A | 1/1992 | Tackett, Jr. | 166/295 |
| 5,131,472 | A | 7/1992 | Dees et al. | |
| 5,216,050 | A | 6/1993 | Sinclair | |
| 5,224,540 | A | 7/1993 | Streich et al. | 166/118 |
| 5,271,468 | A | 12/1993 | Streich et al. | |
| 5,294,469 | A | 3/1994 | Suzuki et al. | |
| 5,390,737 | A | 2/1995 | Jacobi et al. | |
| 5,439,055 | A | 8/1995 | Card et al. | 166/280 |
| 5,439,059 | A | 8/1995 | Harris et al. | |
| 5,460,226 | A | 10/1995 | Lawson et al. | 166/300 |
| 5,479,986 | A | 1/1996 | Gano et al. | |
| 5,540,279 | A | 7/1996 | Branch et al. | |
| 5,591,700 | A | 1/1997 | Harris et al. | 507/204 |
| 5,607,905 | A | 3/1997 | Dobson, Jr. et al. | 507/211 |
| 5,685,372 | A | 11/1997 | Gano | |
| 5,689,085 | A | 11/1997 | Turner | |
| 5,698,322 | A | 12/1997 | Tsai et al. | 428/373 |
| 5,701,959 | A | 12/1997 | Hushbeck et al. | |
| 5,765,641 | A | 6/1998 | Shy et al. | |
| 5,839,515 | A | 11/1998 | Yuan et al. | |
| 5,849,401 | A | 12/1998 | El-Afandi et al. | 428/215 |
| 5,984,007 | A | 11/1999 | Yuan et al. | |
| 5,990,051 | A | 11/1999 | Ischy et al. | |
| 6,102,117 | A | 8/2000 | Swor et al. | |
| 6,131,661 | A | 10/2000 | Conner et al. | 166/300 |
| 6,135,987 | A | 10/2000 | Tsai et al. | 604/365 |
| 6,143,698 | A | 11/2000 | Murphey et al. | 507/145 |
| 6,161,622 | A | 12/2000 | Robb et al. | |
| 6,162,766 | A | 12/2000 | Muir et al. | 507/267 |
| 6,189,615 | B1 | 2/2001 | Sydansk | 166/270 |
| 6,209,646 | B1 | 4/2001 | Reddy et al. | |
| 6,218,343 | B1 | 4/2001 | Burts, Jr. | |
| 6,220,349 | B1 | 4/2001 | Vargus et al. | |
| 6,242,390 | B1 | 6/2001 | Mitchell et al. | 507/211 |
| 6,318,460 | B1 | 11/2001 | Swor et al. | |
| 6,323,307 | B1 | 11/2001 | Bigg et al. | |
| 6,328,105 | B1 | 12/2001 | Betzold | |
| 6,378,606 | B1 | 4/2002 | Swor et al. | |
| 6,387,986 | B1 | 5/2002 | Moradi-Araghi et al. | 523/211 |
| 6,394,185 | B1 | 5/2002 | Constien | 166/296 |
| 6,422,314 | B1 | 7/2002 | Todd et al. | |
| 6,444,316 | B1 | 9/2002 | Reddy et al. | |
| 6,481,497 | B1 | 11/2002 | Swor et al. | |
| 6,494,263 | B1 | 12/2002 | Todd | |
| 6,527,051 | B1 | 3/2003 | Reddy et al. | |
| 6,554,071 | B1 | 4/2003 | Reddy et al. | |
| 6,599,863 | B1 | 7/2003 | Palmer et al. | |
| 6,655,459 | B1 | 12/2003 | Mackay | |
| 6,666,275 | B1 | 12/2003 | Neal et al. | |
| 6,667,279 | B1 | 12/2003 | Hessert et al. | |
| 6,669,771 | B1 | 12/2003 | Tokiwa et al. | 106/162 |
| 6,681,856 | B1 | 1/2004 | Chatterji et al. | |
| 6,710,019 | B1 | 3/2004 | Sawdon et al. | 507/136 |
| 6,761,218 | B1 | 7/2004 | Nguyen et al. | 166/278 |
| 2001/0016562 | A1 | 8/2001 | Muir et al. | 507/201 |
| 2002/0036088 | A1 | 3/2002 | Todd | 166/300 |
| 2002/0125012 | A1 | 9/2002 | Dawson et al. | 166/300 |
| 2003/0060374 | A1 | 3/2003 | Cooke, Jr. | 507/200 |
| 2003/0114314 | A1 | 6/2003 | Ballard et al. | 507/100 |
| 2003/0130133 | A1 | 7/2003 | Vallmer | 507/100 |
| 2003/0168214 | A1 | 9/2003 | Sollesnes | 166/250.08 |
| 2003/0213601 | A1 | 11/2003 | Schwendemann et al. | |
| 2003/0234103 | A1 | 12/2003 | Lee et al. | 166/293 |
| 2004/0014607 | A1 | 1/2004 | Sinclair et al. | 507/200 |
| 2004/0040706 | A1 | 3/2004 | Hossaini et al. | 166/278 |
| 2004/0231845 | A1 | 11/2004 | Cooke, Jr. | 166/279 |
| 2005/0006095 | A1 | 1/2005 | Justus, et al. | 166/295 |

FOREIGN PATENT DOCUMENTS

| | | |
|---|---|---|
| WO | WO 2001/02698 | 1/2001 |
| WO | WO 2004/007905 | 1/2004 |
| WO | WO 04/037946 A1 | 5/2004 |
| WO | WO 04/038176 A1 | 5/2004 |

OTHER PUBLICATIONS

Heller, et al., *Poly(ortho esters)—From Concept To Reality*, Biomacromolecules, vol. 5, No. 5, 2004 (pp. 1625-1632).

Schwach-Abdellaoui, et al., *Hydrolysis and Erosion Studies of Autocatalyzed Poly(ortho esters) Containing Lactoyl-Lactyl Acid Dimers*, American Chemical Society, vol. 32, No. 2, 1999 (pp. 301-307).

Ng, et al., *Synthesis and Erosion Studies of Self-Catalyzed Poly(ortho ester)*s, American Chemical Society, vol. 30, No. 4, 1997 (pp. 770-772).

Ng, et al., *Development Of A Poly(ortho ester) prototype With A Latent Acid In The Polymer Backbone For 5-fluorouracil Delivery*, Journal of Controlled Release 65 (2000), (pp. 367-374).

Rothen-Weinhold, et al., Release of BSA from poly(ortho ester) extruded thin strands, *Journal of Controlled Release 71*,2001, (pp. 31-37).

Heller, et al., *Poly(ortho ester)s—their development and some recent applications*, European Journal of Pharmaceutics and Biopharmaceutics, 50, 2000, (pp. 121-128).

Heller, et al., *Poly(ortho esters); synthesis, characterization, properties and uses*, Advanced Drug Delivery Reviews, 54, 2002, (pp. 1015-1039).

Heller, et al., *Poly(ortho esters) For The Pulsed And Continuous Delivery of Peptides And Proteins*, Controlled Release and Biomedical Polymers Department, SRI International, (pp. 39-46).

Zignani, et al., *Subconjunctival biocompatibility of a viscous bioerodable poly(ortho ester)*, J. Biomed Mater Res, 39, 1998, pp. 277-285.

Toncheva, et al., *Use of Block Copolymers of Poly(Ortho Esters) and Poly(Ethylene Glycol)*, Journal of Drug Targeting, 2003, vol. 11(6), pp. 345-353.

Schwach-Abdellaoui, et al., *Control of Molecular Weight For Auto-Catalyzed Poly(ortho ester) Obtained by Polycondensation Reaction*, International Journal of Polymer Anal. Charact., 7: 145-161, 2002, pp. 145-161.

Heller, et al., *Release of Norethindrone from Poly(Ortho Esters)*, Polymer Engineering and Science, Mid-August, 1981, vol. 21, No. 11 (pp. 727-731).

Y. Chiang et al.: "Hydrolysis of Ortho Esters: Further Investigation of the Factors Which Control the Rate-Determining Step," Engineering Information Inc., NY, NY, vol. 105, No. 23 (XP-002322842).

M. Ahmad, et al.: "Ortho Ester Hydrolysis: Direct Evidence for a Three-Stage Reaction Mechanism," Engineering Information Inc., NY,NY, vol. 101, No. 10 (XP-002322843).

Cantu, et al., "Laboratory and Field Examination of a Combined Fluid-Loss Control Additive and Gel Breaker For Fracturing Fluids," SPE Paper 18211 (1990).

Paper entitled "Controlled Ring-Opening Polymerization of Lactide and Glycolide" by Odile Dechy-Cabaret et al., dated 2004.

Simmons, et al., "Poly(phenyllactide): Synthesis, Characterization, and Hydrolytic Degradation," Biomacromolecules, vol. 2, No. 3, 2001 (pp. 658-663).

Yin, et al., "Preparation and Characterization of Substituted Polylactides," Am. Chem. Soc., vol. 32, No. 23, 1999 (pp. 7711-7718).

Yin, et al., "Synthesis and Properties of Polymers Derived from Substituted Lactic Acids," Am. Chem. Soc., Ch. 12, 2001 (pp. 147-159).

Patent application entitled "Bidegradable Downhole Tools," by Bradley T. Todd, filed concurrently herewith.

* cited by examiner

ONE-TIME USE COMPOSITE TOOL FORMED OF FIBERS AND A BIODEGRADABLE RESIN

CROSS REFERENCE TO RELATED APPLICATIONS

The present application is related to co-pending U.S. patent application Ser. No. 10/803,689, filed on Mar. 18, 2004, and entitled "Biodegradable Downhole Tools," which is owned by the assignee thereof, and is hereby incorporated herein by reference in its entirety.

FIELD OF THE INVENTION

The present invention relates generally to tools for use in downhole environments, and more particularly to disposable downhole tools formed of fibers and a biodegradable resin.

BACKGROUND OF THE INVENTION

In the drilling of oil and gas wells, there are a number of tools that are used only once. That is, the tool is sent downhole for a particular task, and then not used again. These tools are commonly referred to as "one-time" use tools. Examples of such one-time use tools include fracture plugs, bridge plugs, free-falling plugs, downhole darts, and drillable packers. While these devices perform useful and needed operations, some of these devices have the drawback of having to be removed from the well bore when their application is finished. Typically, this is accomplished by drilling the tool out of the well. Such an operation requires at least one trip of a drill string or coil tubing, which takes rig time and has an associated expense. In order to minimize the time required to drill these devices out of the well bore, efforts have been made to design devices that are easily drillable. The challenge in such design, however, is that because these devices also have certain strength requirements that need to be met so that they can adequately perform their designated task, the material used in their construction must also have adequate mechanical strength.

SUMMARY OF THE INVENTION

The present invention is directed to a disposable downhole tool that eliminates or at least minimizes the drawbacks of prior one-time use tools. In one aspect, the present invention is directed to a disposable composite downhole tool comprising at least one fiber and a biodegradable resin that desirably decomposes when exposed to a well bore environment. In one embodiment, a single fiber or plurality of fibers is formed into a fabric, which is coated with the biodegradable resin. In another embodiment, both the fibers and the resin are formed of a degradable polymer, such as polylactide. As used herein, the terms polylactide or poly (lactide) and polylactic acid are used interchangeably.

In another aspect, the present invention is directed to a system for performing a one-time downhole operation comprising a downhole tool comprising at least one resin-coated fiber and an enclosure for storing a chemical solution that catalyzes decomposition of the downhole tool. In one embodiment, the chemical solution is a basic fluid, an acidic fluid, an enzymatic fluid, an oxidizer fluid, a metal salt catalyst solution or combination thereof. The system further comprises an activation mechanism for releasing the chemical solution from the enclosure. In one certain embodiment, the activation mechanism is a frangible enclosure body.

In yet another aspect, the present invention is directed to a method for performing a one-time downhole operation comprising the steps of installing within a well bore a disposable composite downhole tool comprising at least one fiber and a biodegradable resin and decomposing the tool in situ via exposure to the well bore environment. The method further comprises the step of selecting the at least one biodegradable resin to achieve a desired decomposition rate of the tool. The method further comprises the step of catalyzing decomposition of the tool by applying a chemical solution to the tool.

In still another aspect, the present invention is directed to a method of manufacturing a disposable downhole tool that decomposes when exposed to a well bore environment comprising the step of forming the disposable composite downhole tool with at least one fiber and a biodegradable resin. The disposable downhole tool may be formed using any known technique for forming rigid components out of fiberglass or other composites.

DETAILED DESCRIPTION

Figure 1:
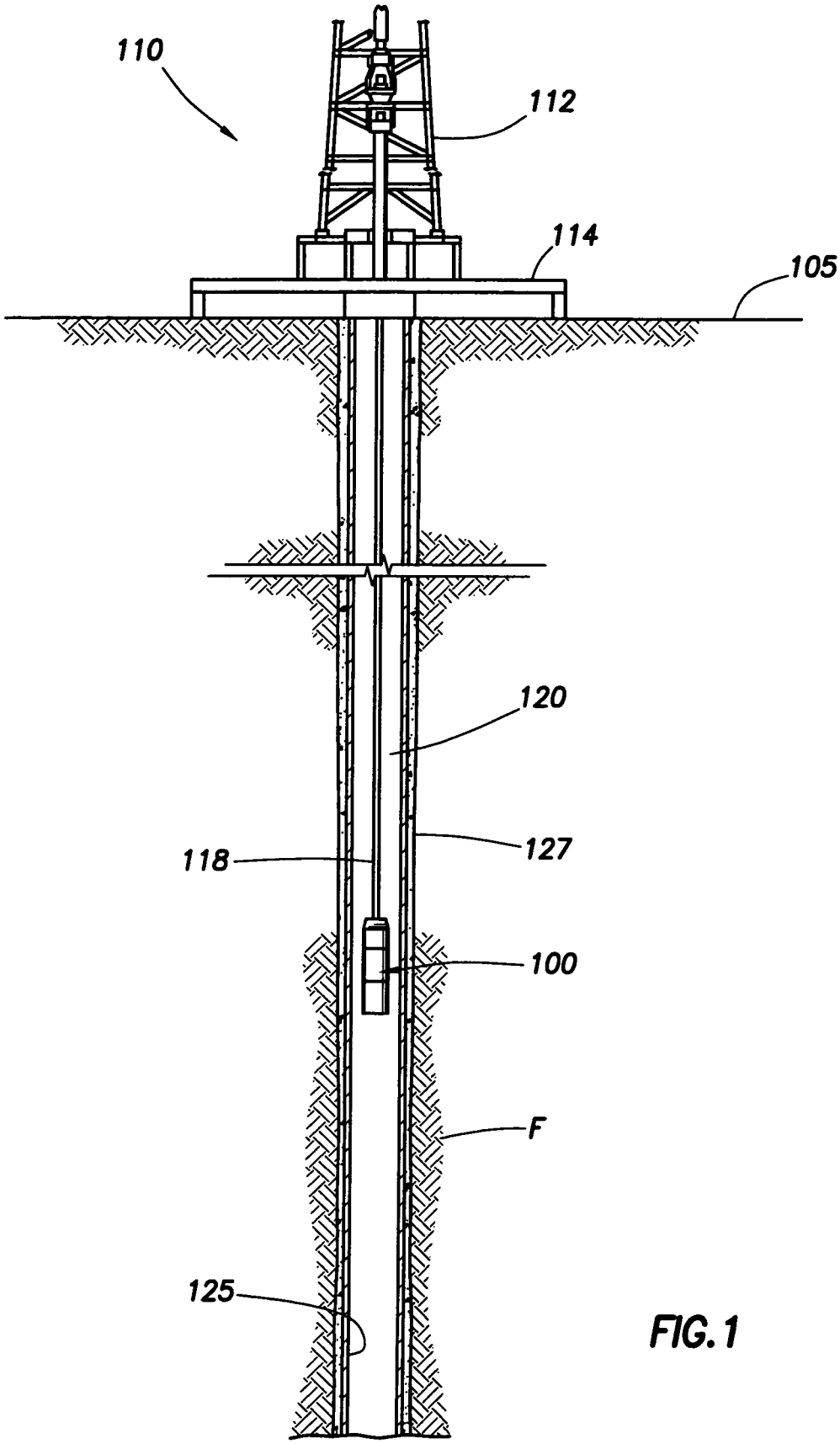
FIG. 1 is a schematic, cross-sectional view of an exemplary operating environment depicting a biodegradable downhole tool being lowered into a well bore extending into a subterranean hydrocarbon formation.

FIG. 1 schematically depicts an exemplary operating environment for a biodegradable downhole tool 100. As depicted, a drilling rig or work over unit 110 is positioned on the earth's surface (land and marine) 105 and extends over a well bore 120 that penetrates a subterranean formation F for the purpose of recovering hydrocarbons. At least the upper portion of the well bore 120 may be lined with casing 125 that is cemented 127 into position against the formation F in a conventional manner. The drilling rig 110 includes a derrick 112 with a rig floor 114 through which a string 118, such as a wireline, jointed pipe, or coiled tubing, for example, extends downwardly from the drilling rig 110 into the well bore 120. The string 118 suspends an exemplary biodegradable downhole tool 100, which may comprise a frac plug, a bridge plug, or a packer, for example, as it is being lowered to a predetermined depth within the well bore 120 to perform a specific operation. The drilling rig or work over unit 110 is conventional and therefore includes a motor driven winch and other associated equipment for extending the string 118 into the wellbore 120 to position the tool 100 at the desired depth.

While the exemplary operating environment of FIG. 1 depicts a stationary drilling rig 110 for lowering and setting the biodegradable downhole tool 100 within the well bore 120, one of ordinary skill in the art will readily appreciate that instead of a drilling rig 110, mobile workover rigs, well servicing units, offshore rigs and the like, may be used to lower the tool 100 into the well bore 120.

Figure 2:
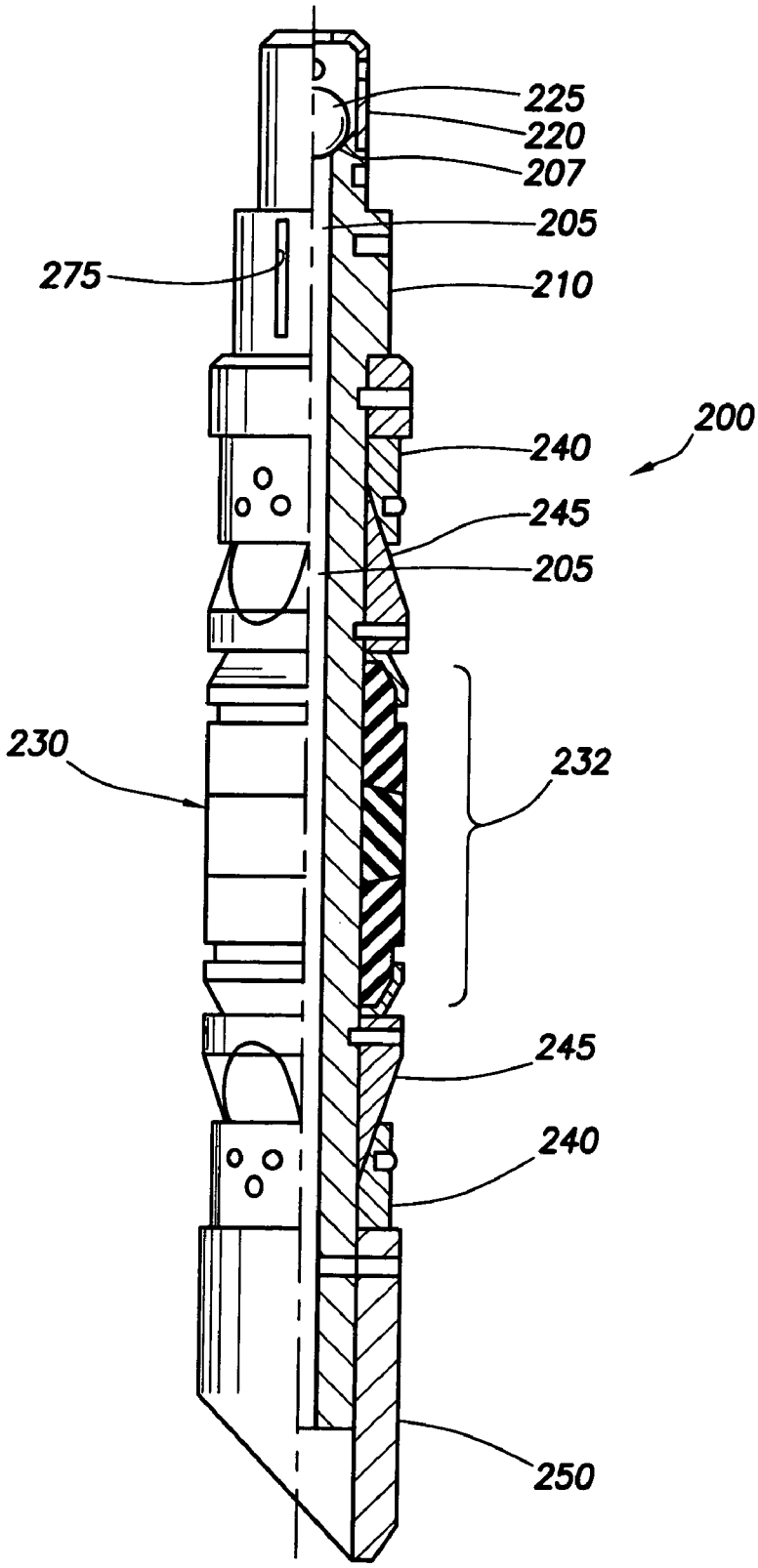
FIG. 2 is an enlarged side view, partially in cross section, of an embodiment of a biodegradable downhole tool comprising a frac plug.

Structurally, the biodegradable downhole tool 100 may take a variety of different forms. In one exemplary embodiment, the tool 100 comprises a plug that is used in a well stimulation/fracturing operation, commonly known as a "frac plug." FIG. 2 depicts an exemplary biodegradable frac plug, generally designated as 200, comprising an elongated tubular body member 210 with an axial flowbore 205 extending therethrough. A cage 220 is formed at the upper end of the body member 210 for retaining a ball 225 that acts as a one-way check valve. In particular, the ball 225 seats with the upper surface 207 of the flowbore 205 to prevent flow downwardly therethrough, but permits flow upwardly through the flowbore 205. A packer element assembly 230, which may comprise a plurality of sealing elements 232, extends around the body member 210. A plurality of slips 240 are mounted around the body member 210 both above and below the packer assembly 230. Mechanical slip bodies 245 permit slips 240 to slide up and down providing a guide for the slips. The slips 240 expand outward as the lower slip body moves downward and the upper slip body moves upward. A tapered shoe 250 is provided at the lower end of the body member 210 for guiding and protecting the frac plug 200 as it is lowered into the well bore 120. An optional enclosure 275 for storing a chemical solution may also be mounted on the body member 210 or may be formed integrally therein. In one exemplary embodiment, the enclosure 275 is formed of a frangible material.

At least some components of the frac plug 200, or portions thereof, are formed from a composite material comprising fibers and a biodegradable resin. More specifically, the frac plug 200 comprises an effective amount of resin-coated biodegradable fibers such that the plug 200 desirably decomposes when exposed to a well bore environment, as further described below. The particular material matrix of the biodegradable resin used to form the biodegradable components of the frac plug 200 may be selected for operation in a particular pressure and temperature range, or to control the decomposition rate of the plug 200. Thus, a biodegradable frac plug 200 may operate as a 30-minute plug, a three-hour plug, or a three-day plug, for example, or any other timeframe desired by the operator.

Nonlimiting examples of degradable materials that may be used in forming the biodegradable fibers and resin coating include but are not limited to degradable polymers. Such degradable materials are capable of undergoing an irreversible degradation downhole. The term "irreversible" as used herein means that the degradable material, once degraded downhole, should not recrystallize or reconsolidate while downhole, e.g., the degradable material should degrade in situ but should not recrystallize or reconsolidate in situ. The terms "degradation" or "degradable" refer to both the two relatively extreme cases of hydrolytic degradation that the degradable material may undergo, i.e., heterogeneous (or bulk erosion) and homogeneous (or surface erosion), and any stage of degradation in between these two. This degradation can be a result of, inter alia, a chemical reaction, thermal reaction, a reaction induced by radiation, or by an enzymatic reaction. The degradability of a polymer depends at least in part on its backbone structure. For instance, the presence of hydrolyzable and/or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it degrades, e.g., temperature, presence of moisture, oxygen, microorganisms, enzymes, pH, and the like.

Suitable examples of degradable polymers that may be used in accordance with the present invention include but are not limited to those described in the publication of Advances in Polymer Science, Vol. 157 entitled "Degradable Aliphatic Polyesters" edited by A.-C. Albertsson and the publication "Biopolymers" Vols. 1–10, especially Vol. 3b, Polyester II: Properties and Chemical Synthesis and Vol. 4, Polyester III: Application and Commercial Products edited by Alexander Steinbüchel, Wiley-VCM. Specific examples include homopolymers, random, block, graft, and star- and hyper-branched aliphatic polyesters. Polycondensation reactions, ring-opening polymerizations, free radical polymerizations, anionic polymerizations, carbocationic polymerizations, coordinative ring-opening polymerization, and any other suitable process may prepare such suitable polymers. Specific examples of suitable polymers include polysaccharides such as dextran or cellulose; chitins; chitosans; proteins; aliphatic polyesters; poly(lactides); poly(glycolides); poly(ϵ-caprolactones); poly(hydroxybutyrates); poly(anhydrides); aliphatic polycarbonates; poly(orthoesters); poly(amino acids); poly(ethylene oxides); and polyphosphazenes. Of these suitable polymers, aliphatic polyesters and polyanhydrides are preferred.

Aliphatic polyesters degrade chemically, inter alia, by hydrolytic cleavage. Hydrolysis can be catalyzed by either acids, bases or metal salt catalyst solutions. Generally, during the hydrolysis, carboxylic end groups are formed during chain scission, and this may enhance the rate of further hydrolysis. This mechanism is known in the art as "autocatalysis," and is thought to make polyester matrices more bulk eroding.

Suitable aliphatic polyesters have the general formula of repeating units shown below:

Formula I

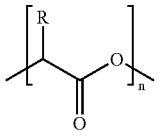

where n is an integer between 75 and 10,000 and R is selected from the group consisting of hydrogen, alkyl, aryl, alkylaryl, acetyl, heteroatoms, and mixtures thereof. Of the suitable aliphatic polyesters, poly(lactide) is preferred. Poly (lactide) is synthesized either from lactic acid by a condensation reaction or more commonly by ring-opening polymerization of cyclic lactide monomer. Since both lactic acid and lactide can achieve the same repeating unit, the general term poly(lactic acid) as used herein refers to formula I without any limitation as to how the polymer was made such as from lactides, lactic acid, or oligomers, and without reference to the degree of polymerization or level of plasticization.

The lactide monomer exists generally in three different forms: two stereoisomers L- and D-lactide and racemic D,L-lactide (meso-lactide). The oligomers of lactic acid, and oligomers of lactide are defined by the formula:

Formula II

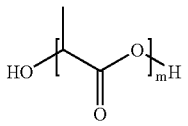

where m is an integer $2 \leqq m \leqq 75$. Preferably m is an integer and $2 \leqq m \leqq 10$. These limits correspond to number average molecular weights below about 5,400 and below about 720, respectively. The chirality of the lactide units provides a means to adjust, inter alia, degradation rates, as well as physical and mechanical properties. Poly(L-lactide), for instance, is a semicrystalline polymer with a relatively slow hydrolysis rate. This could be desirable in applications of the present invention where a slower degradation of the degradable material is desired. Poly(D,L-lactide) may be a more amorphous polymer with a resultant faster hydrolysis rate. This may be suitable for other applications where a more rapid degradation may be appropriate. The stereoisomers of lactic acid may be used individually or combined to be used in accordance with the present invention. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified to be used in the present invention by, inter alia, blending, copolymerizing or otherwise mixing the stereoisomers, blending, copolymerizing or otherwise mixing high and low molecular weight polylactides, or by blending, copolymerizing or otherwise mixing a polylactide with another polyester or polyesters.

Plasticizers may be present in the polymeric degradable materials of the present invention. The plasticizers may be present in an amount sufficient to provide the desired characteristics, for example, (a) more effective compatibilization of the melt blend components, (b) improved processing characteristics during the blending and processing steps, and (c) control and regulation of the sensitivity and degradation of the polymer by moisture. Suitable plasticizers include but are not limited to derivatives of oligomeric lactic acid, selected from the group defined by the formula:

Formula III

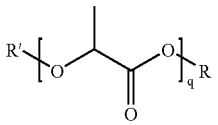

where R is a hydrogen, alkyl, aryl, alkylaryl, acetyl, heteroatom, or a mixture thereof and R is saturated, where R' is a hydrogen, alkyl, aryl, alkylaryl, acetyl, heteroatom, or a mixture thereof and R' is saturated, where R and R' cannot both be hydrogen, where q is an integer and $2 \leqq q \leqq 75$; and mixtures thereof. Preferably q is an integer and $2 \leqq q \leqq 10$. As used herein the term "derivatives of oligomeric lactic acid" includes derivatives of oligomeric lactide. The plasticizers may enhance the degradation rate of the degradable polymeric materials. The plasticizers, if used, are preferably at least intimately incorporated within the degradable polymeric materials.

Examples of plasticizers useful for this purpose include, but are not limited to, polyethylene glycol; polyethylene oxide; oligomeric lactic acid; citrate esters (such as tributyl citrate oligomers, triethyl citrate, acetyltributyl citrate, acetyltriethyl citrate); glucose monoesters; partially fatty acid esters; PEG monolaurate; triacetin; Poly(caprolactone); poly(hydroxybutyrate); glycerin-1-benzoate-2,3-dilaurate; glycerin-2-benzoate-1,3-dilaurate; starch; bis(butyl diethylene glycol)adipate; ethylphthalylethyl glycolate; glycerine diacetate monocaprylate; diacetyl monoacyl glycerol; polypropylene glycol; poly(propylene glycol)dibenzoate; dipropylene glycol dibenzoate; glycerol; ethyl phthalyl rthyl glycolate; poly(ethylene adipate)disterate; di-iso-butyl adipate; and combinations thereof.

Aliphatic polyesters useful in the present invention may be prepared by substantially any of the conventionally known manufacturing methods such as those described in U.S. Pat. Nos. 6,323,307; 5,216,050; 4,387,769; 3,912,692; and 2,703,316, which are hereby incorporated herein by reference in their entirety.

Polyanhydrides are another type of particularly suitable degradable polymer useful in the present invention. Polyanhydride hydrolysis proceeds, inter alia, via free carboxylic acid chain-ends to yield carboxylic acids as final degradation products. The erosion time can be varied over a broad range by changing the polymer backbone. Examples of suitable polyanhydrides include poly(adipic anhydride), poly (suberic anhydride), poly(sebacic anhydride), and poly (dodecanedioic anhydride). Other suitable examples include but are not limited to poly(maleic anhydride) and poly (benzoic anhydride).

The physical properties of degradable polymers depend on several factors such as the composition of the repeat units, flexibility of the chain, presence of polar groups, molecular mass, degree of branching, crystallinity, orientation, etc. For example, short chain branches reduce the degree of crystallinity of polymers while long chain branches lower the melt viscosity and impart, inter alia, elongational viscosity with tension-stiffening behavior. The properties of the material utilized can be further tailored by blending, and copolymerizing it with another polymer, or by a change in the macromolecular architecture (e.g., hyperbranched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains. For example, poly(phenyllactide) will degrade at about ⅕th of the rate of racemic poly(lactide) at a pH of 7.4 at 55° C. One of ordinary skill in the art with the benefit of this disclosure will be able to determine the appropriate degradable polymer to achieve the desired physical properties of the degradable polymers.

In choosing the appropriate degradable material, one should consider the degradation products that will result, which in this case is a disposable downhole tool. These degradation products should not adversely affect other operations or components. The choice of degradable material also can depend, at least in part, on the conditions in the well, e.g., well bore temperature. For instance, copolymers of poly(lactide) and poly(glycolide) have been found to be suitable for lower temperature wells, including those within the range of 60° F. to 150° F., and poly(lactide) has been found to be suitable for well bore temperatures above this range. Some stereoisomers of poly(lactide) [a 1:1 mixture of poly(D-lactide) and poly(L-lactide)] or a mixture of these stereoisomers with poly(lactide), poly(D-lactide) or poly(L-lactide), may be suitable for even high temperature applications.

Figure 3:
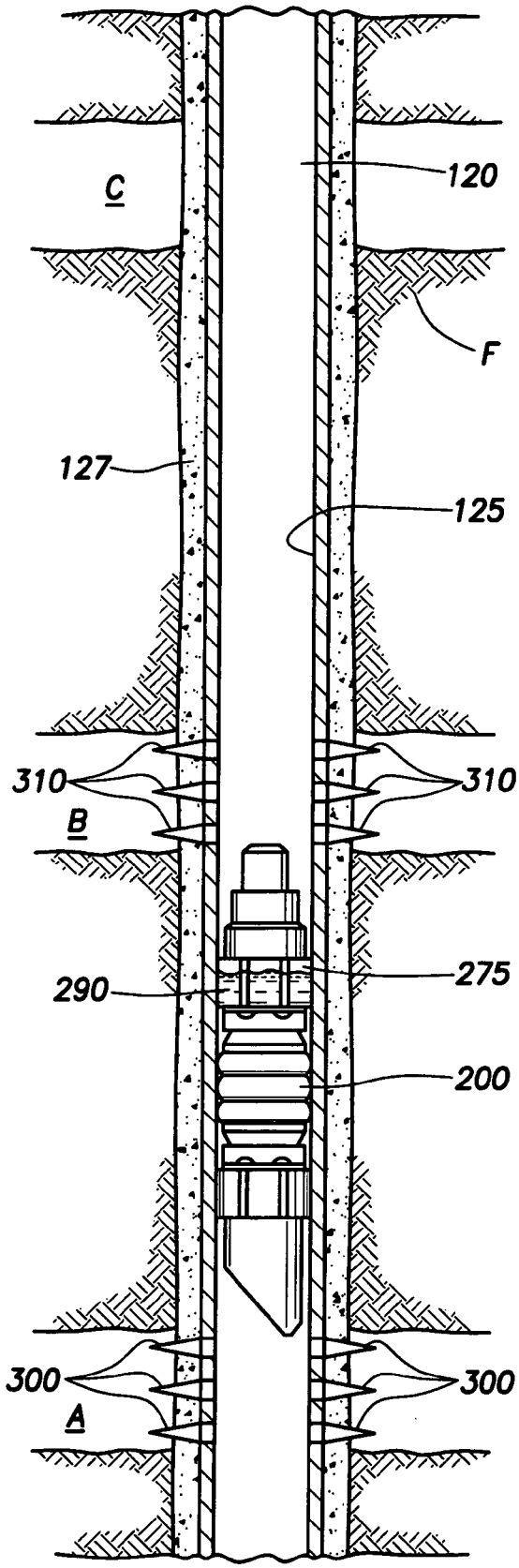
FIG. 3 is an enlarged cross-sectional side view of a well bore having a representative biodegradable downhole tool with an optional enclosure installed therein.

In operation, the frac plug 200 of FIG. 2 may be used in a well stimulation/fracturing operation to isolate the zone of the formation F below the plug 200. Referring now to FIG. 3, the frac plug 200 is shown disposed between producing zone A and producing zone B in the formation F. In a conventional well stimulation/fracturing operation, before setting the frac plug 200, a plurality of perforations 300 are made by a perforating tool (not shown) through the casing 125 and cement 127 to extend into producing zone A. Then a well stimulation fluid is introduced into the well bore 120, such as by lowering a conduit (not shown) into the well bore 120 for discharging the fluid at a relatively high pressure or by pumping the fluid directly from the drilling rig 110 into the well bore 120. The well stimulation fluid passes through the perforations 300 into producing zone A of the formation F for stimulating the recovery of fluids in the form of oil and gas containing hydrocarbons. These production fluids pass from zone A, through the perforations 300, and up the well bore 120 for recovery at the drilling rig 110.

The frac plug 200 is then lowered by the string 118 to the desired depth within the well bore 120 (as shown in FIG. 1), and the packer element assembly 230 is set against the casing 125 in a conventional manner, thereby isolating zone A as depicted in FIG. 3. Due to the design of the frac plug 200, the ball 225 within cage 220 will unseat from the upper surface 207 of the flowbore 205 to allow fluid from isolated zone A to flow upwardly through the frac plug 200, but the ball 225 will seat against the upper surface 207 of the flowbore 205 to prevent flow downwardly into the isolated zone A. Accordingly, the production fluids from zone A continue to pass through the perforations 300, into the well bore 120, and upwardly through the flowbore 205 of the frac plug 200, before recovery at the drilling rig 110.

After the frac plug 200 is set into position as shown in FIG. 3, a second set of perforations 310 may then be formed through the casing 125 and cement 127 adjacent intermediate producing zone B of the formation F. Zone B is then treated with well stimulation fluid, causing the recovered fluids from zone B to pass through the perforations 310 into the well bore 120. In this area of the well bore 120 above the frac plug 200, the recovered fluids from zone B will mix with the recovered fluids from zone A before flowing upwardly within the well bore 120 for recovery at the drilling rig 110.

If additional well stimulation/fracturing operations will be performed, such as recovering hydrocarbons from zone C, additional frac plugs 200 may be installed within the well bore 120 to isolate each zone of the formation F. Each frac plug 200 allows fluid to flow upwardly therethrough from the lowermost zone A to the uppermost zone C of the formation F, but pressurized fluid cannot flow downwardly through the frac plug 200.

After the fluid recovery operations are complete, the frac plug(s) 200 must be removed from the well bore 120. In this context, as stated above, at least some components of the frac plug 200, or portions thereof, are formed of a composite material comprising a biodegradable and/or non-biodegradable fiber(s) and a biodegradable resin. More specifically, the frac plug 200 comprises an effective amount of biodegradable material such that the plug 200 desirably decomposes when exposed to a well bore environment. In particular, these biodegradable materials will decompose in the presence of an aqueous fluid and a well bore temperature of at least 100° F. A fluid is considered to be "aqueous" herein if the fluid comprises water alone or if the fluid contains water. Aqueous fluids may be present naturally in the well bore 120, or may be introduced to the well bore 120 before, during, or after downhole operations. Alternatively, the frac plug 200 may be exposed to an aqueous fluid prior to being installed within the well bore 120.

Accordingly, the frac plug 200 is designed to decompose over time in a well bore environment, thereby eliminating the need to mill or drill the frac plug 200 out of the well bore 120. Thus, by exposing the biodegradable frac plug 200 to well bore temperatures and an aqueous fluid, at least some of its components will decompose, causing the frac plug 200 to lose structural and/or functional integrity and release from the casing 125. The remaining components of the plug 200 will simply fall to the bottom of the well bore 120.

As stated above, the biodegradable material forming components of the frac plug 200 may be selected to control the decomposition rate of the plug 200. However, in some cases, it may be desirable to catalyze decomposition of the frac plug 200 by applying a chemical solution to the plug 200. The chemical solution comprises a basic fluid, an acidic fluid, an enzymatic fluid, an oxidizer fluid, a metal salt catalyst solution or combination thereof, and may be applied before or after the frac plug 200 is installed within the well bore 120. Further, the chemical solution may be applied before, during, or after the fluid recovery operations. For those embodiments where the chemical solution is applied before or during the fluid recovery operations, the biodegradable material, the chemical solution, or both may be selected to ensure that the frac plug 200 decomposes over time while remaining intact during its intended service.

The chemical solution may be applied by means internal to or external to the frac plug 200. In an embodiment, an optional enclosure 275 is provided on the frac plug 200 for storing the chemical solution 290 as depicted in FIG. 3. An activation mechanism (not shown), such as a slideable valve, for example, may be provided to release the chemical solution 290 from the optional enclosure 275 onto the frac plug 200. This activation mechanism may be timer-controlled or operated mechanically, hydraulically, chemically, electrically, or via a wireless signal, for example. This embodiment would be advantageous for fluid recovery operations using more than one frac plug 200, since the activation mechanism for each plug 200 could be actuated as desired to release the chemical solution 290 from the enclosure 275 so as to decompose each plug 200 at the appropriate time with respect to the fluid recovery operations.

Figure 4:
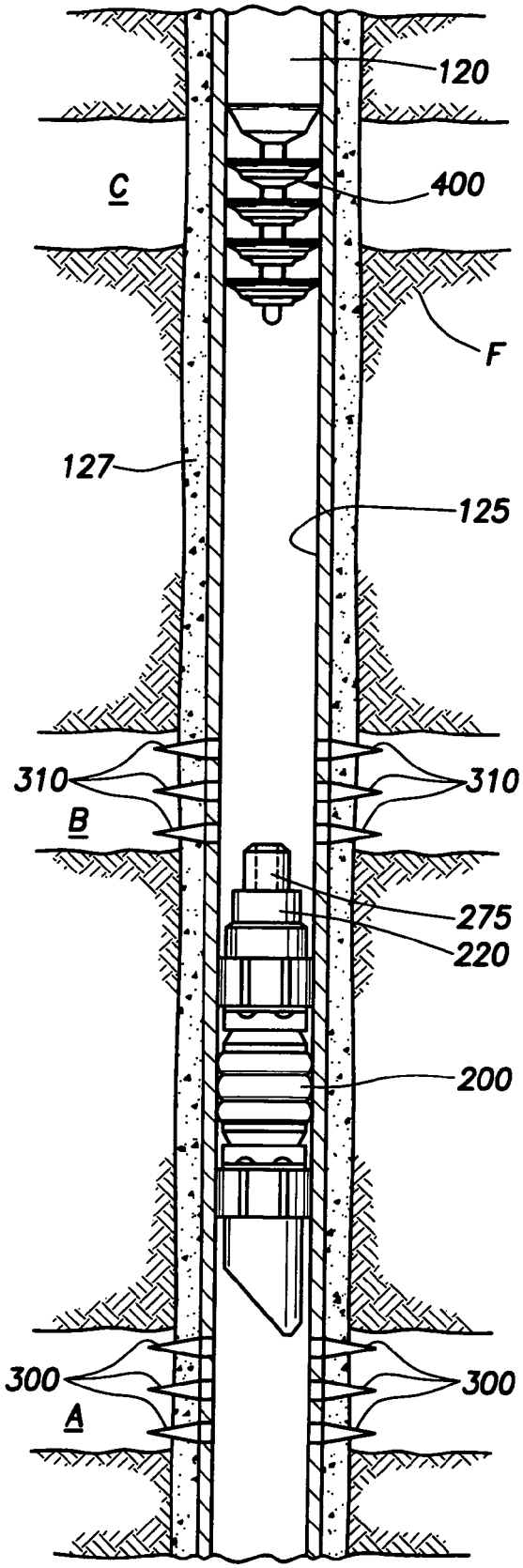
FIG. 4 is an enlarged cross-sectional side view of a well bore with a biodegradable downhole tool installed therein and with a dart descending in the well bore toward the tool.

As depicted in FIG. 4, in another embodiment, a dart 400 releases the chemical solution 290 onto the frac plug 200. In one embodiment, the optional enclosure 275 on the frac plug 200 is positioned above the cage 220 on the uppermost end of the frac plug 200, and the dart 400 descends via gravity within (or is pumped down) the well bore 120 to engage the enclosure 275. In an embodiment, the dart 400 actuates the activation mechanism to mechanically release the chemical solution from the enclosure 275 onto the frac plug 200. In another embodiment, the optional enclosure 275 is frangible, and the dart 400 engages the enclosure 275 with enough force to break it, thereby releasing the chemical solution onto the frac plug 200. In yet another embodiment, the chemical solution is stored within the dart 400, which is frangible. In this embodiment, the dart 400 descends via gravity (or is pumped) within the well bore 120 and engages the frac plug 200 with enough force to break the dart 400, thereby releasing the chemical solution onto the plug 200.

Figure 5:
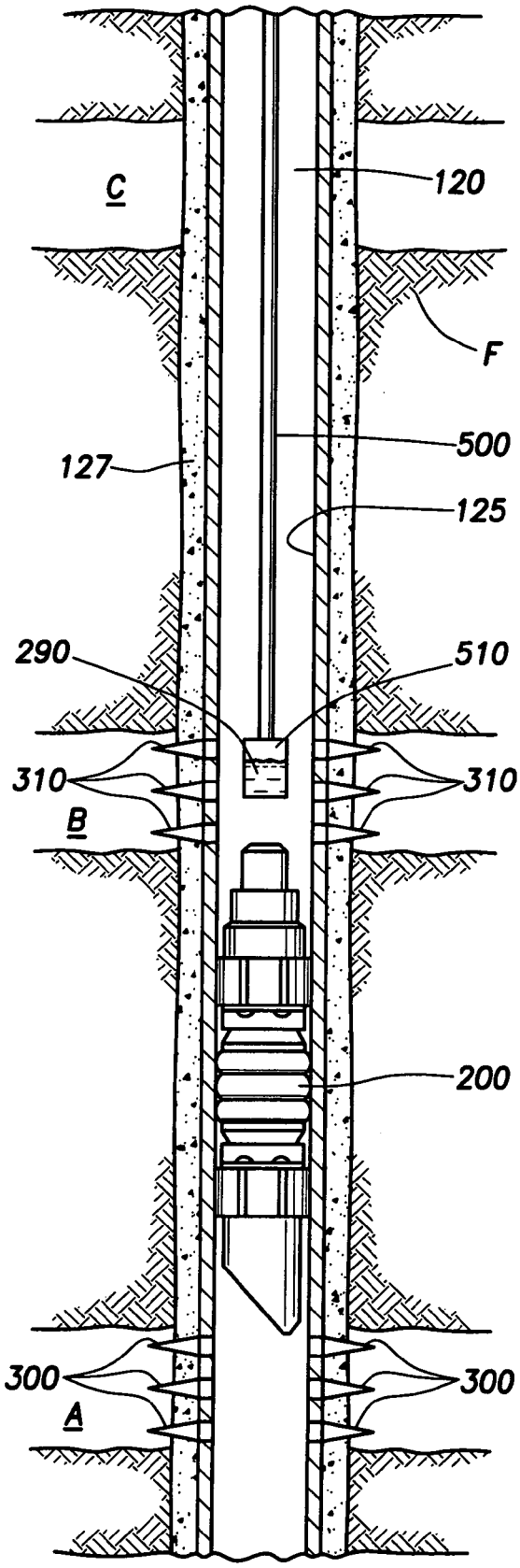
FIG. 5 is an enlarged cross-sectional side view of a well bore with a biodegradable downhole tool installed therein and with a line lowering a frangible object containing chemical solution towards the tool.

Referring now to FIG. 5, in another embodiment, a slick line 500 may be used to lower a container 510 filled with chemical solution 290 adjacent the frac plug 200 to release the chemical solution 290 onto the plug 200. In an embodiment, the container 510 is frangible and is broken upon engagement with the frac plug 200 to release the chemical solution 290 onto the plug 200. In various other embodiments, the chemical solution 290 may be released from the container 510 via a timer-controlled operation, a mechanical operation, a hydraulic operation, an electrical operation, via a wireless signal or other means of communication, for example.

Figure 6:
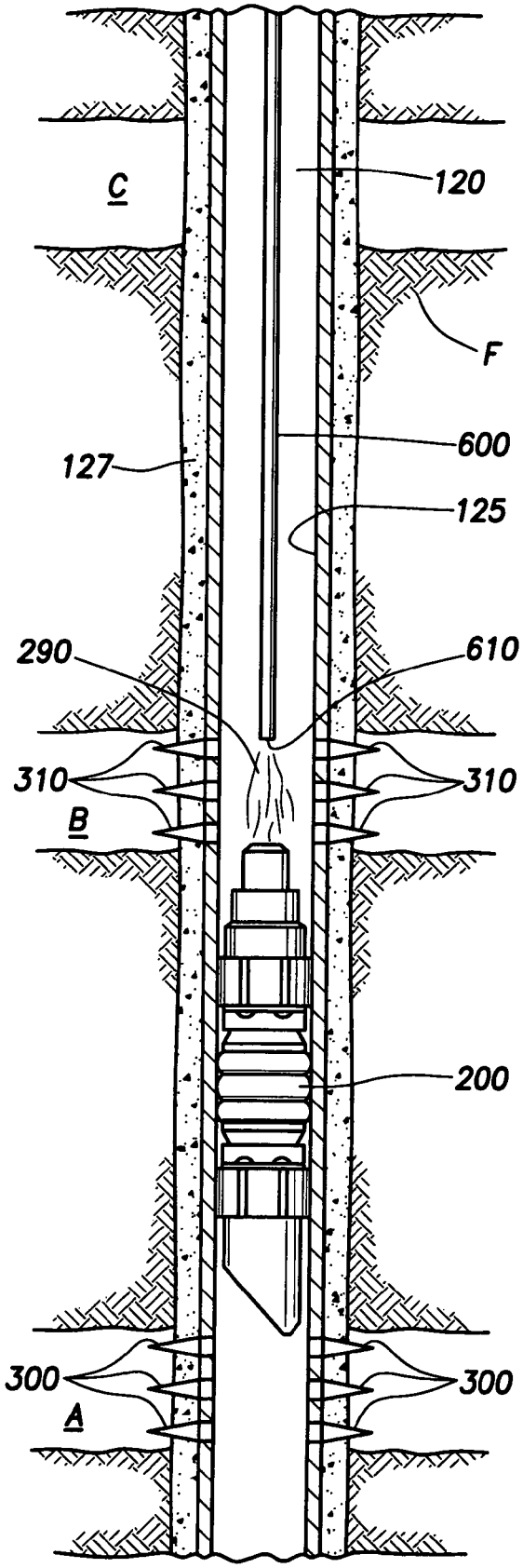
FIG. 6 is an enlarged cross-sectional side view of a well bore with a biodegradable downhole tool installed therein and with a conduit extending towards the tool to dispense chemical solution.

FIG. 6 depicts another embodiment of a system for applying the chemical solution 290 to the frac plug 200 comprising a conduit 600, such as a coiled tubing or work string, that extends into the well bore 120 to a depth where the terminal end 610 of the conduit 600 is adjacent the frac plug 200. Chemical solution 290 may then flow downwardly through the conduit 600 to spot on top of the frac plug 200. Alternatively, if the chemical solution 290 is more dense than the other fluids in the well bore 120, the chemical solution 290 could be dispensed directly into the well bore 120 at the drilling rig 110 to flow downwardly to the frac plug 200 without using conduit 600. In another embodiment, the chemical solution 290 may be dispensed into the well bore 120 during fluid recovery operations. In a preferred embodiment, the fluid that is circulated into the well bore 120 during the downhole operation comprises both the aqueous fluid and the chemical solution 290 to decompose the frac plug 200.

Removing a biodegradable downhole tool 100, such as the frac plug 200 described above, from the well bore 120 is more cost effective and less time consuming than removing conventional downhole tools, which requires making one or more trips into the well bore 120 with a mill or drill to gradually grind or cut the tool away, which has the disadvantage of potentially damaging the casing. Further, biodegradable downhole tools 100 are removable, in most cases, by simply exposing the tools 100 to a naturally occurring downhole environment. The foregoing descriptions of specific embodiments of the biodegradable tool 100, and the systems and methods for removing the biodegradable tool 100 from the well bore 120 have been presented for purposes of illustration and description and are not intended to be exhaustive or to limit the invention to the precise forms disclosed. Obviously many other modifications and variations are possible. In particular, the type of biodegradable downhole tool 100, or the particular components that make up the downhole tool 100 could be varied. For example, instead of a frac plug 200, the biodegradable downhole tool 100 could comprise a bridge plug, which is designed to seal the well bore 120 and isolate the zones above and below the bridge plug, allowing no fluid communication therethrough. Alternatively, the biodegradable downhole tool 100 could comprise a cement plug or a packer that includes a shiftable valve such that the packer may perform like a bridge plug to isolate two formation zones, or the shiftable valve may be opened to enable fluid communication therethrough.

The manufacture of the biodegradable components of the frac plug 200 according to the present invention will now be described. In one embodiment, a fiber formed of a biodegradable polymer such as a poly(lactide) or polyanhydride is run through a dip tray containing a liquid resin of the same biodegradable polymer, i.e., poly(lactide) or polyanhydride. The biodegradable fiber is then spun onto a steel mandrel, which is preferably heated in a chamber to enhance the chemical bonding of the polymer resin to the polymer fiber. The fiber is spun in a helical formation. In one embodiment, the angle of the helix is about 10°. In such a configuration, the windings of the fiber are very close to one another, such that they contact one another. In this configuration, there is essentially no space between adjacent windings. This configuration results in the formation of one continuous layer. The fiber can be spun over itself, so as to form additional layers of the material, thereby increasing the resulting blank's thickness.

In another alternate embodiment, the angle of the helix formed by the spun biodegradable fiber is about 45°, which results in gaps being formed between adjacent windings of the fiber. These gaps can be filled by winding the fiber over itself many times in a criss-cross like pattern. As those of ordinary skill in the art will recognize, the angle of the helix and pattern of the windings can be varied. The object is to create a fiber reinforced continuous cylindrical blank form. As those of ordinary skill in the art will further appreciate, the number of windings, angle of the helix and pattern of the windings can be modified to vary the strength and dimensions of the cylindrical blank, which will become, or used as a component of, the desired downhole tool, in this case frac plug 200.

After the biodegradable fiber has been wound around the mandrel, it is allowed to cure. In one certain embodiment, the mandrel is placed in a temperature controlled environment. In one example, the fiber is allowed to cure for a period of approximately 2 hours, at a temperature of 100° C. Once the fiber hardens into the cylindrical blank, the blank is removed and placed on a lathe, or other machining tool such as a CNC (computer numerically controlled) device. The blank is then machined to the desired configuration.

In one alternate embodiment, a fabric formed of the biodegradable fiber is dipped into the resin and spun onto the mandrel. The fabric can be of the woven or nonwoven type.

In another method of manufacture, the downhole tool or component thereof is formed using an injection molding process. In such a process, the biodegradable fibers or fabric are stuffed into the mold, so as to occupy the void space of the mold. The mold is then injected with the molten resin. Preferably, once the mold is filled with the resin, a vacuum is applied to the mold to remove any remaining air. The mold is then cured. The resultant structure then may be machined as necessary. In an alternate to this embodiment, the biodegradable fabric lines the mold, i.e., it is placed along the contour of the mold. The mold is then injected with the resin and cured, as described immediately above.

Other details of preparing the resin and fibers in accordance with the present invention can be gleamed from U.S. Pat. Nos. 5,294,469 and 4,743,257, which are hereby incorporated herein by reference in their entirety.

As those of ordinary skill in the art will recognize, there are many different ways of manufacturing downhole tools in accordance with the present invention. Indeed, virtually any technique, which is used in manufacturing rigid structures out of fiberglass can be used. Indeed, the present invention has applicability in replacing fiberglass in many applications. The advantages of the present invention over fiberglass, however, are that it is biodegradable and the bond formed between the resin and the fibers is a chemical bond, as opposed to a mechanical bond, as with fiberglass. Chemical bonds are generally considered to be stronger than mechanical bonds. However, in at least one embodiment, the present invention is directed to a composite material comprising fiberglass or other type of non-biodegradable fiber and a biodegradable resin. Such other types of non-biodegradable fibers include, but are not limited to, kevlar, nylon, nyomex, carbon fibers, carbon nanotubes, and rigid rod polymers.

Non-reinforcing fillers can also be added to the fiber or resin so as to bulk up the volume and density of the tool or enhance the thermal, mechanical, electrical and/or chemical properties of the tool. Such filler materials include silicas, silicates, metal oxides, ceramic powders, calcium carbonate, chalk, powdered metal, mica and other inert materials. Modified bentonite, colloidal silicas and aerated silicas can also be used. Powdered metals, alumina, beryllia, mica and silica, for example, may be used to improve the thermal properties of the tool. Aluminum oxide, silica, fibrous fillers, $CaCO_3$, phenolic micro balloons may be used to improve the mechanical properties of the tool. Mica, hydrated alumina silicates, and zirconium silicates may be used to improve the electrical properties of the tool. And mica, silica, and hydrated aluminum may be used to improve the chemical resistance of the tool. Those skilled in the art will recognize that other suitable materials can be used to increase the volume and density of the composite and enhance its thermal, mechanical, electrical and chemical resistance properties. The filler contents of the biodegradable resin is in the range of 1–50% by weight and the size of fillers is from 10 nanometers to 200 microns.

Furthermore, adding nanometer size particles of $CaCO_3$ (50–70 nm) or organically modified layered silicates can significantly improve the material properties of the tool, such as its mechanical properties, flexural properties, and oxygen gas permeability. Intercalated nanocomposites show high mechanical properties, so the material can be chosen depending upon use. Crosslinking of the polymer can also be done using crosslinkers to enhance the mechanical properties of the tool.

In one certain example, the composite material can be formed of PLA (polylactic acid) blended with 10–30% by weight of nanometer sized particles of $CaCO_3$ to improve the modulus of elasticity, high bending strength. These small particles also behave as nucleating sites for the polymer so that they can form well defined polymer domain and also enhances the crystallinity of the material.

In another example, the fiber is made of one of the stereoisomers of polylactide [1:1 mixture of poly(L-lactide) and poly(D-lactide)], which melts at about 230° C., and the resin is formed of a mixture of the poly(D-lactide), poly(L-lactide), or poly(D,L-lactide). In yet another example, the fiber or fibers are formed of a non-biodegradable fiber, including, e.g., but not limited to, fiberglass, kevlar, nylon, nyomex, carbon fibers, carbon nanotubes, and rigid rod polymers and the resin is formed of one of the stereoisomers of polylactic acid or mixture of poly(D-lactide), poly(L-lactide), or poly(D,L-lactide).

While various embodiments of the invention have been shown and described herein, modifications may be made by one skilled in the art without departing from the spirit and the teachings of the invention. The embodiments described here are exemplary only, and are not intended to be limiting. Indeed, as those of ordinary skill in the art will appreciate, any number of combinations of fiber materials and resins may be used and many different methods of forming these tools into one time use tools may be employed with the spirit of the present invention. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A disposable composite downhole tool comprising at least one fiber and a biodegradable resin that desirably decomposes when exposed to a well bore environment.

2. The disposable downhole tool of claim 1 wherein the at least one fiber is formed into a fabric.

3. The disposable downhole tool of claim 2 wherein the fabric is woven.

4. The disposable downhole tool of claim 2 wherein the fabric is nonwoven.

5. The disposable downhole tool of claim 1 wherein the at least one fiber comprises a degradable polymer.

6. The disposable downhole tool of claim 5 wherein the resin comprises a degradable polymer.

7. The disposable downhole tool of claim 6 wherein the resin and the at least one biodegradable fiber comprise a degradable polymer, which comprises an aliphatic polyester.

8. The disposable downhole tool of claim 7 wherein the aliphatic polyester comprises a poly(lactide).

9. The disposable downhole tool of claim 8 wherein the poly(lactide) comprises poly(L-lactide), poly(D-lactide), or poly(D,L-lactide).

10. The disposable downhole tool of claim 6 wherein the resin and the at least one fiber comprise a degradable polymer, which comprises a polyanhydride.

11. The disposable downhole tool of claim 6 wherein the resin and the at least one fiber further comprise plasticizers.

12. The disposable downhole tool of claim 11 wherein the plasticizers are selected from the group consisting of derivatives of oligomeric lactic acid; polyethylene glycol; polyethylene oxide; oligomeric lactic acid; citrate esters (such as tributyl citrate oligomers, triethyl citrate, acetyltributyl citrate, acetyltriethyl citrate); glucose monoesters; partially fatty acid esters; PEG monolaurate; triacetin; Poly(caprolactone); poly(hydroxybutyrate); glycerin-1-benzoate-2,3-dilaurate; glycerin-2-benzoate-1,3-dilaurate; starch; bis(butyl diethylene glycol)adipate; ethylphthalylethyl glycolate; glycerine diacetate monocaprylate; diacetyl monoacyl glycerol; polypropylene glycol; poly(propylene glycol)dibenzoate; dipropylene glycol dibenzoate; glycerol; ethyl phthalyl rthyl glycolate; poly(ethylene adipate)disterate; diiso-butyl adipate; and combinations thereof.

13. The disposable downhole tool of claim 1 wherein the resin and the at least one fiber comprise one or more compounds selected from the group consisting of polysaccharides such as dextran or cellulose; chitin; chitosan; proteins; aliphatic polyesters; poly(lactide); poly(glycolide); poly(ϵ-caprolactone); poly(hydroxybutyrate); poly(anhydrides); aliphatic polycarbonates; poly(orthoesters); poly(amino acids); poly(ethylene oxide); and polyphosphazenes.

14. The disposable downhole tool of claim 1 wherein the resin and the at least one fiber comprise one or more compounds selected from the group consisting of poly(adipic anhydride), poly(suberic anhydride), poly(sebacic anhydride), poly(dodecanedioic anhydride), poly(maleic anhydride), and poly(benzoic anhydride).

15. The disposable downhole tool of claim 1 wherein the biodegradable resin is selected to achieve a desired decomposition rate when the tool is exposed to the well bore environment.

16. The disposable downhole tool of claim 1 wherein the well bore environment comprises an aqueous fluid.

17. The disposable downhole tool of claim 1 wherein the well bore environment comprises a well bore temperature of at least 600° F.

18. The disposable downhole tool of claim 1 wherein the decomposition is due to hydrolysis.

19. The disposable downhole tool of claim 1 wherein the tool decomposes within about a predetermined amount of time.

20. The disposable downhole tool of claim 1 further comprising at least one non-reinforcing filler material.

21. The disposable downhole tool of claim 20 wherein the at least one non-reinforcing filler material is selected from the group consisting of an alumina, beryllia, mica, silica, silicate, zirconium silicate, aluminum oxide, fibrous filler, $CaCO_3$, hydrated alumina, and phenolic microballoon.

22. The disposable downhole tool of claim 1 wherein the at least one fiber is formed of one of the stereoisomers of polylactic acid and the resin is formed of poly(D, L lactide).

23. The disposable downhole tool of claim 1 wherein the at least one fiber is formed of a material selected from the group consisting of fiberglass, polygylcolic acid, kevlar, nylon, nyomex, carbon fibers, carbon nanotubes and rigid rod polymers.

24. The disposable downhole tool of claim 23 wherein the biodegradable resin is formed of one of the stereoisomers of polylactic acid.

25. The disposable downhole tool of claim 23 wherein the biodegradable resin is formed of poly(D, L lactide).

26. A disposable composite downhole tool comprising at least one aliphatic polyester fiber formed of a stereoisomer of polylactic acid and an aliphatic polyester resin formed of a mixture of L-lactide and D-lactide that desirably decomposes when exposed to a well bore environment.

27. The disposable downhole tool of claim 26 further comprising at least one non-reinforcing filler material.

28. The disposable downhole tool of claim 27 wherein the at least one non-reinforcing filler material is selected from the group consisting of an alumina, beryllia, mica, silica, silicate, zirconium silicate, aluminum oxide, fibrous filler, $CaCO_3$, hydrated alumina, and phenolic microballoon.

29. A disposable composite downhole tool comprising a fabric formed of at least one poly(lactide) or polyanhydride fiber and a poly(lactide) or polyanhydride resin that desirably decomposes when exposed to a well bore environment.

30. The disposable downhole tool of claim 29 further comprising at least one non-reinforcing filler material.

31. The disposable downhole tool of claim 30 wherein the at least one non-reinforcing filler material is selected from the group consisting of an alumina, beryllia, mica, silica, silicate, zirconium silicate, aluminum oxide, fibrous filler, $CaCO_3$, hydrated alumina, and phenolic microballoon.

32. A system for performing a one-time downhole operation comprising a composite downhole tool comprising at least one fiber and a biodegradable resin and an enclosure for storing a chemical solution that catalyzes decomposition of the downhole tool.

33. The system of claim 32 wherein the chemical solution comprises a basic fluid, an acidic fluid, an enzymatic fluid, an oxidizer fluid, a metal salt catalyst solution or combination thereof.

34. The system of claim 32 further comprising an activation mechanism for releasing the chemical solution from the enclosure.

35. The system of claim 34 wherein the activation mechanism comprises a frangible enclosure body.

36. The disposable downhole tool of claim 32 further comprising at least one non-reinforcing filler material.

37. The disposable downhole tool of claim 36 wherein the at least one non-reinforcing filler material is selected from the group consisting of an alumina, beryllia, mica, silica, silicate, zirconium silicate, aluminum oxide, fibrous filler, $CaCO_3$, hydrated alumina, and phenolic microballoon.

38. A method for performing a one-time downhole operation comprising the steps of installing within a well bore a disposable composite downhole tool comprising at least one fiber and a biodegradable resin and decomposing the tool in situ via exposure to the well bore environment.

39. The method of claim 38 wherein the at least one fiber comprises a degradable polymer.

40. The method of claim 39 further comprising the step of selecting the at least one biodegradable resin to achieve a desired decomposition rate of the tool.

41. The method of claim 38 wherein the well bore environment comprises a well bore temperature of at least 600° F.

42. The method of claim 38 further comprising the step of exposing the tool to an aqueous fluid.

43. The method of claim 42 wherein the tool is exposed to the aqueous fluid before the tool is installed in the well bore.

44. The method of claim 42 wherein the tool is exposed to the aqueous fluid while the tool is installed within the well bore.

45. The method of claim 38 wherein the tool decomposes via hydrolysis.

46. The method of claim 38 wherein the tool decomposes within about a predetermined amount of time.

47. The method of claim 38 further comprising the step of catalyzing decomposition of the tool by applying a chemical solution to the tool.

48. The method of claim 47 wherein the chemical solution comprises a basic fluid, an acidic fluid, an enzymatic fluid, an oxidizer fluid, a metal salt catalyst solution or combination thereof.

49. The method of claim 47 wherein the chemical solution is applied to the tool before the downhole operation.

50. The method of claim 47 wherein the chemical solution is applied to the tool during the downhole operation.

51. The method of claim 47 wherein the chemical solution is applied to the tool after the downhole operation.

52. The method of claim 47 wherein the chemical solution is applied to the tool via the step of dispensing the chemical solution into the well bore.

53. The method of claim 52 wherein the dispensing step comprises the steps of lowering a frangible object containing the chemical solution into the well bore and breaking the frangible object.

54. The method of claim 47 further comprising the steps of dropping a dart into the well bore and engaging the dart with the tool to release the chemical solution.

55. The method of claim 54 wherein the dart contains the chemical solution.

56. The method of claim 54 wherein the tool contains the chemical solution.

57. The method of claim 38 wherein the at least one fiber is formed into a fabric.

58. The method of claim 38 wherein the resin and the at least one biodegradable fiber comprise a degradable polymer.

59. The method of claim 38 wherein the resin and the at least one biodegradable fiber comprise one or more compounds selected from the group consisting of polysaccharides such as dextran or cellulose; chitin; chitosan; proteins; aliphatic polyesters; poly(lactide); poly(glycolide); poly(ε-caprolactone); poly(hydroxybutyrate); poly(anhydrides); aliphatic polycarbonates; poly(orthoesters); poly(amino acids); poly(ethylene oxide); and polyphosphazenes.

60. The method of claim 38 wherein the resin and the at least one biodegradable fiber comprise one or more compounds selected from the group consisting of poly(adipic anhydride), poly(suberic anhydride), poly(sebacic anhydride), poly(dodecanedioic anhydride), poly(maleic anhydride), and poly(benzoic anhydride).

61. The method of claim 38 wherein the downhole tool further comprises at least one non-reinforcing filler material.

62. The method of claim 61 wherein the at least one non-reinforcing filler material is selected from the group consisting of an alumina, beryllia, mica, silica, silicate, zirconium silicate, aluminum oxide, fibrous filler, $CaCO_3$, hydrated alumina, and phenolic microballoon.

63. A method for performing a one-time downhole operation comprising the steps of installing within a well bore a disposable composite downhole tool comprising at least one poly(lactide) or polyanhydride fiber and a poly(lactide) or polyanhydride resin and decomposing the tool in situ via exposure to the well bore environment.

64. The method of claim 63 wherein the downhole tool further comprises at least one non-reinforcing filler material.

65. The method of claim 64 wherein the at least one non-reinforcing filler material is selected from the group consisting of an alumina, beryllia, mica, silica, silicate, zirconium silicate, aluminum oxide, fibrous filler, $CaCO_3$, hydrated alumina, and phenolic microballoon.

* * * * *